United States Patent [19]

Decker

[11] Patent Number: 4,917,152

[45] Date of Patent: Apr. 17, 1990

[54] FLUID INJECTOR

[76] Inventor: William T. Decker, 101 Ridgewood Rd., Bristol, Tenn. 37620

[21] Appl. No.: 393,416

[22] Filed: Aug. 14, 1989

[51] Int. Cl.[4] ..... B01F 5/04

[52] U.S. Cl. ..... 137/891; 137/888; 417/182

[58] Field of Search ..... 137/888, 891, 892, 893; 417/151, 182

[56] References Cited

U.S. PATENT DOCUMENTS 2,181,069 11/1939 Robinson ..... 137/891
4,270,576 6/1981 Takeda ..... 137/888

FOREIGN PATENT DOCUMENTS 1030814 5/1958 Fed. Rep. of Germany ..... 137/892
689303 3/1953 United Kingdom ..... 137/892

*Primary Examiner*—Robert G. Nilson

[57] ABSTRACT

A fluid injector consisting of an airfoil cross-sectioned rectangular plate mounted on and perpendicular to a pivoted hollow tube and suspended within a flowing stream of fluid into which another or the same type of fluid is to be injected through the tubular support exiting out the top surface of the plate and mixing with the primary fluid by means of vortices created at the rear side edges of the wing shaped plate. The quantity of injected fluid is controlled by the angle the plate is set in reference to the direction of flow of the primary fluid.

3 Claims, 1 Drawing Sheet

FLUID INJECTOR

BACKGROUND OF THE INVENTION

1. Field of the Invention

The present invention relates to a method of controlling the injection and mixing of a fluid into another fluid flowing with a larger volume and velocity.

2. Prior Art

A venturi is a device which accomplishes the same task as the stated invention which is less difficult to construct, has more accurate control of the volume of injected fluid and is more efficient in the immediate mixing of the two fluids.

SUMMARY OF THE INVENTION

The principal objective of the present invention is to provide a cost effective simple method of injecting a fluid into a flowing fluid with excellent injection volume control and mixing of the two fluids.

Injection can be controlled from zero to a maximum by changing the angle of attack of the airfoil wing shaped invention with the streamline of the flowing fluid. Mixing is accomplished with the aid of the vortices generated at the wing tips of this wing shaped invention. Construction of the airfoil shaped wing can be made from any suitable material such as wood, metal or plastic using any number of different manufacturing processes such as extrusion, casting or machining.

DETAILED DESCRIPTION

Figure 1:
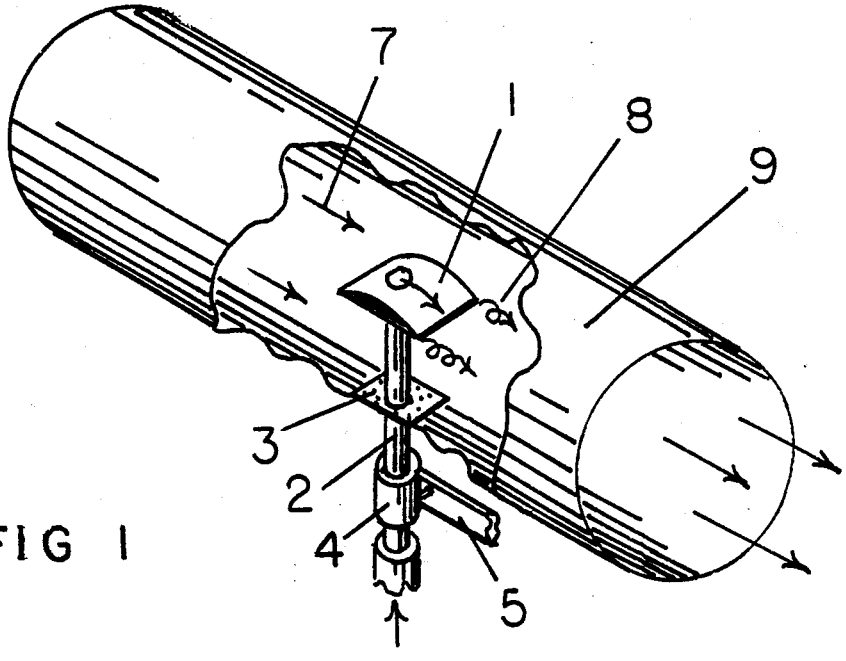
FIG. 1 is a perspective of the injection device within a flowing fluid medium which may be a liquid or a gas.

FIG. 1 is a perspective showing the injector inserted in a pipe 9 containing a flowing fluid 7. The wing shaped injector plate 1 which has an airfoil crossection is placed at an angle of attack with the flowing fluid 7 so as to create the desired vacuum which pulls the fluid 6 to be injected through an injector tube 2 that exits at the center of the top surface of the wing plate 1 approximately one-third the crossection cord length back from the leading edge of the wing plate 1. The injected fluid 6 is thoroughly mixed with the fluid stream 7 by the action of the vortices 8 emanating from the wing tips of the wing plate 1. A flexible seal 3 allows the angle of attack of the wing plate 1 to be changed by means of lever 5 connected to the injector tube 2 at pin connector 4.

Figure 2:
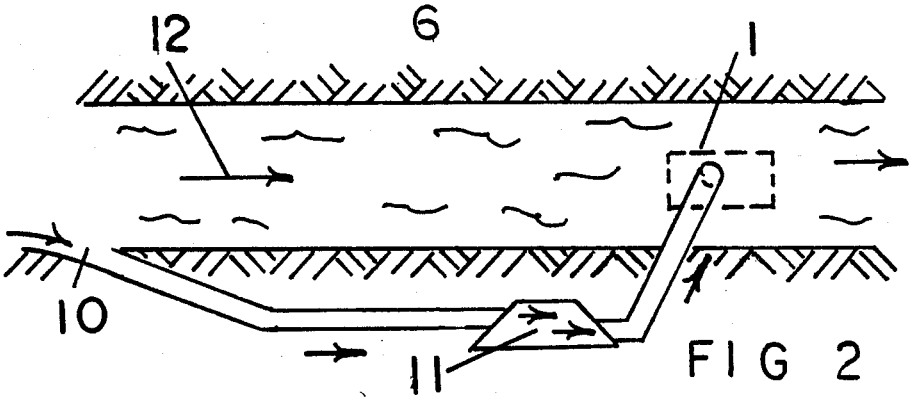
FIG. 2 is a top view diagram showing how this invention can be employed to improve the efficiency as a low head water turbine.
Figure 3:
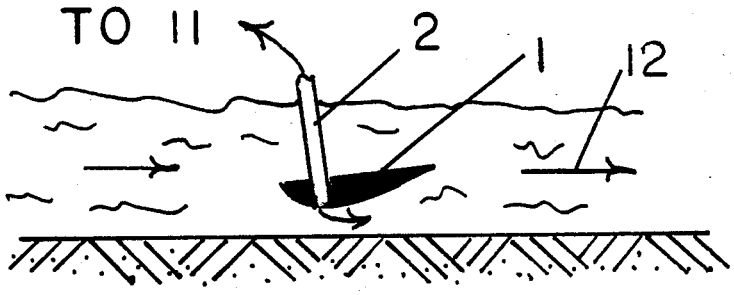
FIG. 3 is a side view showing the position of the injector within a stream of water feeding the turbine.

FIG. 2 illustrates how this invention may be used to increase the power output of a low head water turbine 11. The stream of water 12 enters the turbine intake 10 passes through the turbine 11 and exits out the curved side of the wing plate 1. The vacuum created by the stream of water 12 flowing over the wing plate which is in an inverted position as shown in FIG. 3 increases the total head pressure as seen by the turbine 11 relative to the head pressure resulting from the turbine 11 discharging directly into the stream 12.

I claim:

1. A device for injecting a secondary fluid into a flowing stream of primary fluid comprising:

a. a rectangular flat plate inserted within the primary fluid, b. a hollow tubular support attached perpendicular to the bottom surface of the plate and through which the secondary fluid flows exiting out the top surface of the plate, and c. a means for adjusting the angle the plate makes with the direction of flow of the primary fluid.

2. A device according to claim 1 wherein said plate has an airfoil crossection aligned with the flow of the primary fluid and the tubular support is attached to the plate in the center of the plate span at a distance back from the leading edge one-third the cord length of the airfoil crossection or at the location of the maximum negative pressure on the top surface of the airfoil.

3. A device according to claim 2 wherein the support tube is equipped with a pivot and linkage for tilting the support tube to control the angle the plate makes with the direction of primary fluid flow and a flexible attachment to the entrance end of the support tube for introducing the secondary fluid.

* * * * *